US007562481B2

(12) United States Patent
Esch

(10) Patent No.: US 7,562,481 B2
(45) Date of Patent: Jul. 21, 2009

(54) SLING MOUNTS FOR FIREARMS

(76) Inventor: Brian Esch, 3705 257th Ave. SE., Issaquah, WA (US) 98029

( * ) Notice: Subject to any disclaimer, the term of this patent is extended or adjusted under 35 U.S.C. 154(b) by 303 days.

(21) Appl. No.: 11/403,162

(22) Filed: Apr. 12, 2006

(65) Prior Publication Data

US 2006/0254113 A1 Nov. 16, 2006

Related U.S. Application Data

(60) Provisional application No. 60/670,947, filed on Apr. 12, 2005.

(51) Int. Cl.
*F41C 23/02* (2006.01)

(52) U.S. Cl. ..... 42/85; 24/2.5; 224/150

(58) Field of Classification Search ..... 42/85, 42/74, 75.03; 224/150; 24/2.5
See application file for complete search history.

(56) References Cited

U.S. PATENT DOCUMENTS

| | | | | | |
|---|---|---|---|---|---|
| 279,709 | A | | 6/1883 | Coleman | |
| 612,298 | A | | 10/1898 | Zuberbier | |
| 2,480,662 | A | * | 8/1949 | McKinzie | 42/85 |
| 2,771,699 | A | * | 11/1956 | Herter | 42/85 |
| 2,873,902 | A | | 2/1959 | Decker | |
| 3,081,923 | A | | 3/1963 | Bagby | |
| 3,430,828 | A | | 3/1969 | Gregson | |
| 3,704,537 | A | | 12/1972 | McKinzie | 42/85 |
| 3,715,827 | A | | 2/1973 | McKinzie | |
| 4,015,762 | A | | 4/1977 | Mendillo | 224/45 |
| 4,144,794 | A | * | 3/1979 | Silverman et al. | 84/327 |
| 4,182,469 | A | | 1/1980 | Bennett | 224/150 |
| 4,311,563 | A | | 1/1982 | Opavsky et al. | 203/46 |
| 4,454,675 | A | | 6/1984 | Ives | 42/85 |
| 4,571,872 | A | * | 2/1986 | Johnson | 42/85 |
| 5,038,987 | A | | 8/1991 | Huddleston | 224/258 |
| 5,067,267 | A | | 11/1991 | Ives | 42/85 |
| 5,082,155 | A | | 1/1992 | Salvador | 224/150 |
| 5,165,584 | A | | 11/1992 | Meagher et al. | 224/258 |
| 5,246,154 | A | | 9/1993 | Adams et al. | 224/257 |
| D342,563 | S | | 12/1993 | Tukiendorf | D22/108 |
| D345,652 | S | | 4/1994 | Teed, II | D3/318 |
| 5,303,859 | A | | 4/1994 | Jenkin | 224/149 |
| 5,325,618 | A | | 7/1994 | Turner | 42/85 |
| D359,598 | S | | 6/1995 | Forbes | D30/152 |
| D359,836 | S | | 7/1995 | Shuler | D2/627 |
| 5,433,360 | A | | 7/1995 | Rock | 224/258 |
| D366,149 | S | | 1/1996 | Garza et al. | D3/328 |

(Continued)

OTHER PUBLICATIONS

Cal's Sporting Armory, "MWS Sling/Bipod Accessories," Sep. 14, 2004, URL=http://www.calssportingarmory.com/KnightsArmamentCoMWSSlingAcc.htm, 6 pages.

(Continued)

*Primary Examiner*—Stephen M Johnson
(74) *Attorney, Agent, or Firm*—Seed IP Law Group PLLC

(57) ABSTRACT

A sling mount system having a mount with associated receiver for releasable connection with a swivel connector having a longitudinal axis that lies in the same plane as a longitudinal axis of a weapon and that angles downward away from the butt stock. The receptacle for the swivel connector is integrally formed in the mount to facilitate silent connection and disconnection of the swivel mount thereto.

6 Claims, 12 Drawing Sheets

U.S. PATENT DOCUMENTS

| | | | | |
|---|---|---|---|---|
| 5,575,411 | A | 11/1996 | Hightower | 224/149 |
| D378,954 | S | 4/1997 | Daigle | D3/262 |
| 5,692,334 | A * | 12/1997 | Christensen | 42/76.02 |
| D390,704 | S | 2/1998 | Bloch | D3/327 |
| 5,735,496 | A | 4/1998 | Dube | 248/118 |
| 5,785,010 | A | 7/1998 | Koch | 119/863 |
| 5,810,219 | A | 9/1998 | Rosenfield | 224/150 |
| D400,007 | S | 10/1998 | Stevens | D3/221 |
| 5,915,939 | A | 6/1999 | French | 42/85 |
| 6,016,772 | A | 1/2000 | Noyes | 119/863 |
| 6,068,167 | A | 5/2000 | Hopson | 224/150 |
| D431,885 | S | 10/2000 | Gellenbeck | D30/153 |
| D443,117 | S | 5/2001 | Rubin | D30/153 |
| 6,260,748 | B1 | 7/2001 | Lindsey | 224/150 |
| 6,305,115 | B1 * | 10/2001 | Cook | 42/74 |
| 6,325,258 | B1 | 12/2001 | Verdugo et al. | 224/150 |
| D454,415 | S | 3/2002 | Leverenz | D30/152 |
| 6,354,034 | B1 | 3/2002 | Norris, Sr. | 42/85 |
| D456,957 | S | 5/2002 | Koch | D30/152 |
| D462,513 | S | 9/2002 | Holzhaus, II et al. | D3/221 |
| D462,523 | S | 9/2002 | Kalbach | D3/327 |
| 6,520,390 | B2 | 2/2003 | Verdugo et al. | 224/150 |
| 6,536,153 | B2 | 3/2003 | Lindsey | 42/85 |
| 6,536,154 | B1 | 3/2003 | Norris | 42/85 |
| D479,554 | S | 9/2003 | Boron et al. | D17/20 |
| 6,662,485 | B2 * | 12/2003 | Kay | 42/75.03 |
| 6,775,942 | B2 * | 8/2004 | Compton | 42/85 |
| D495,870 | S | 9/2004 | Verdugo | D3/215 |
| 6,880,490 | B2 | 4/2005 | Hanna | 119/863 |
| D508,726 | S | 8/2005 | Storch | D22/108 |
| D525,336 | S | 7/2006 | Esch | D22/108 |

OTHER PUBLICATIONS

Daniel Defense, Inc.™, "CAR Burnsed Loop Right Hand Shooter," Oct. 26, 2005, URL=http://www.danieldefense.com, 1 page.
Daniel Defense, Inc.™, "CAR Burnsed Loop Ambi," Oct. 26, 2005, URL=http://www.danieldefense.com, 1 page.
Eagle Firearms, "Daniel Defense Inc.™," Sep. 14, 2004, URL=http://www.eaglefirearms.net/Daniel%20Defense.htm, 2 pages.
GG&G Inc., "AR15/M16 Receiver End Plate Sling Adapter For Fixed Stocks," Oct. 26, 2005, URL=http://www.gggaz.com/products/rnp_fixedstock.php, 1 page.
GG&G Inc., "M16/AR15 Receiver End Plate Sling Adapters," Oct. 26, 2005, URL=http://www.gggaz.com/products/rnp_sa.php, 1 page.
GG&G Inc., "Agency Rear Sling Adapter For Collapsible Stocks," Oct. 26, 2005, URL=http://www.gggaz.com/products/arsa_cs.php, 1 page.
ImageEvent, "Slings," Sep. 10, 2003, URL=http://imageevent.com/star_tactical/slings;jsessionid=d4ijqo57×2.rabbit_s, 5 pages.
Knight's Manufacturing Company, 2004, 12 pages.
Lightfighter Tactical, "Daniel Defense EZ Car Mount," Sep. 14, 2004, URL=http://www.lightfighter.com/index.asp?PageAction=VIEWPROD&ProdID=1261, 2 pages.
McMaster-Carr®, "Wave Disc Spring Type" (Technical Drawing), Oct. 26, 2005, URL=http://www.mcmaster.com/addlcontent/cad.asp?reqTyp+cad&PN=9714K28&view=2D&size=2, 1 page.
Michael's of Oregon Co., "Push Button Detachable Swivels," Sep. 14, 2004, URL=http://www.uncle-mikes.com/adtemplate.asp?invky=9004408&catky=&subcatky2, 1 page.
Midwest Tactical, "Sling Mounts," Sep. 14, 2004, URL=http://www.midwesttactical.com/view category.asp?cat=126, 3 pages.
Operation Parts, Sep. 14, 2004, URL=http://www.operationparts.com/knights-armament.html, 7 pages.
Stith, Don, St. Louis Plains Rifle Co., "Historical Background," 1 page.
Tactical Advantage, L.L.C., "TAC:300-SE," 12 pages.
Tactical Advantage, L.L.C., "TAC:680-QRB," 9 pages.
Tactical Link™, "End Plate, Receiver," (Technical Drawing), Nov. 1, 2004, 2 pages.
Tactical Link™, "Pin, Lock," (Technical Drawing), Nov. 1, 2004, 1 page.
Tactical Link™, "V-LR Sling Mount," Aug. 1, 2005, URL=http://www.tacticallink.com/Products.aspx?Cat=9, 2 pages.
The Rifle Sling Home Page, "A Resource for Collectors of Military, Curio and Relic, and Antique Firearms," Apr. 16, 2003, URL=www.Rifleslings.com, 2 pages.
U.S. Tactical Supply, "Urban Ops Sling," Sep. 10, 2003, URL=http://www.ustacticalsupply.com/slings3.shtml, 3 pages.
Wilderness Tactical Products, L.L.C., "Single-Point Tactical Sling," Sep. 9, 2003, URL=http://www.thewilderness.com/Pages/slings_sp.html, 9 pages.
Yankee Hill Machine Co. Inc., "MR Ambidextrous 4 Loop Sling Adapter," Oct. 26, 2005, URL=http://store.botachtactical.com/mrsislad.html, 4 pages.
Yankee Hill Machine Co. Inc., "MR Ambidextrous 2 Loop Sling Adapter," Oct. 26, 2005, URL=http://store.botachtactical.com/mram21oslad.html, 1 page.
Yankee Hill Machine Co. Inc., "YST Rear Sling Adapter," Oct. 26, 2005, URL=http://store.botachtactical.com/ystreslad.html, 1 page.
Young, Aaron, "The Rifle Sling Controversy, To Sling or not to Sling . . . (Should it Really Be a Question?," URL=http://victorian.fortunecity.com/brutalist/484/riflesling.htm, 2 pages.

* cited by examiner

SLING MOUNTS FOR FIREARMS

This application claims priority from U.S. provisional application number 60/670,947, as filed on Apr. 12 2005.

BACKGROUND OF THE INVENTION

1. Field of the Invention

The present invention pertains to the attachment of slings to an object to be carried and, more particularly, to sling mounts adapted for use with firearms to accommodate left handed and right handed users in a variety of tactical environments.

2. Description of the Related Art

Slings are of ancient origin, devised generally of a loop of rope, strap, or a chain for supporting a load. While its history remains unknown, the sling is in widespread use in modern times in connection with a variety of manual and mechanical uses, including baby slings, arm slings, camera slings, musical instrument slings, and weapon slings.

When used manually, a properly designed sling will distribute the load for balance and comfort, and it will facilitate use of the load. For example, a baby sling holds the baby close to the caregiver in a manner that keeps the caregiver's hands free and avoids back strain while keeping the baby in a position to see the caregiver and be fed and comforted. Slings used for musical instruments are designed for load support and comfort while positioning the instrument so it can be played and, in some cases, so that music can be supported thereon for reading by the carrier.

Slings for weapons, and in particular rifles, shotguns, and long-barreled weapons, have been designed to provide not only hands-free support, but to facilitate bringing the weapon quickly into a ready-to-use position. Such designs include those disclosed in U.S. Pat. Nos. 3,211,351; 4,823,491; 5,810,219; 5,971,239; 6,260,748; 6,325,251; 6,536,153; 6,598,330; and D495,870.

One area of concern is accommodating left- and right-handed users of the weapon. Although most users will favor one hand or the other, there are situations in which a user may need to quickly switch orientation, such as when aiming around a right-hand or left-hand corner. In addition, the need frequently arises to quickly and sometimes silently disengage the weapon from the sling while retaining the sling on the user's body.

While various devices in the past have attempted to address the issue of right-handed and left-handed use, they have various disadvantages. For example, U.S. Pat. No. 6,260,748 requires mounting of the sling to the forward gun sight. Tampering with a gun sight or using it as a support is something many gun owners are loath to do. Hence, a need is perceived for an improved sling mounting system and method that overcomes the disadvantages of prior gun sling mounts.

BRIEF SUMMARY OF THE INVENTION

In accordance with the disclosed embodiments of the present invention, a device for attaching a sling to an object is provided. In one embodiment, the device includes means for attachment to the weapon's buffer tube; and an elongate receptacle associated with the attachment means having a longitudinal axis configured to be planar with the butt stock when attached to the buffer tube and to angle away from the buffer tube in a range of 10° to 60°.

In accordance with another embodiment of the invention, a device for mounting a sling to a buffer tube is provided, the device includes a mounting member for mounting the device to the buffer tube; a receiver associated with the mounting member; and a swivel connector configured to be releasably connected to the receiver and to be engaged with the strap.

In accordance with yet another embodiment of the invention, a sling mount is provided that includes a first clamp member having an arcuate-shaped opening in the range of 180° to 270°; a second clamp member having an arcuate-shaped opening configured to complete a 360° opening when attached to the first clamp member; and a receptacle formed in the second clamp member having a longitudinal axis that lies in a same plane as a longitudinal axis of the opening formed by the first and second clamp members, and wherein the receptacle angles away from the longitudinal axis of the opening in the range of 10° to 60°.

As will be readily appreciated from the foregoing, the present invention provides a device for mounting a sling to an object that is readily adapted for attachment to and detachment from the object. It has a fixed opening that does not swivel or move when a user is attempting to attach a connector thereto, such as a swivel connector. This provides for silent coupling and uncoupling of the swivel mount with the device because there are no moving parts, it is easy to maintain, and a user can attach the swivel mount by feel. To facilitate operation in dark or low light environments, the receptacle can be formed in a dished face or countersunk to guide the swivel mount into the receptacle.

Furthermore, the disclosed embodiments of the present invention provides a single attachment point for quick and simple attachment, and it facilitates rapid weapon indexing and smooth transition of the firearm from shoulder to shoulder for ease in "pieing" corners and clearing structures.

BRIEF DESCRIPTION OF THE SEVERAL VIEWS OF THE DRAWINGS

The foregoing and other features and advantages of the present invention will be more readily appreciated as the same become better understood from the following detailed description when taken in conjunction with the accompanying drawings, wherein.

DETAILED DESCRIPTION OF THE INVENTION

Figure 1:
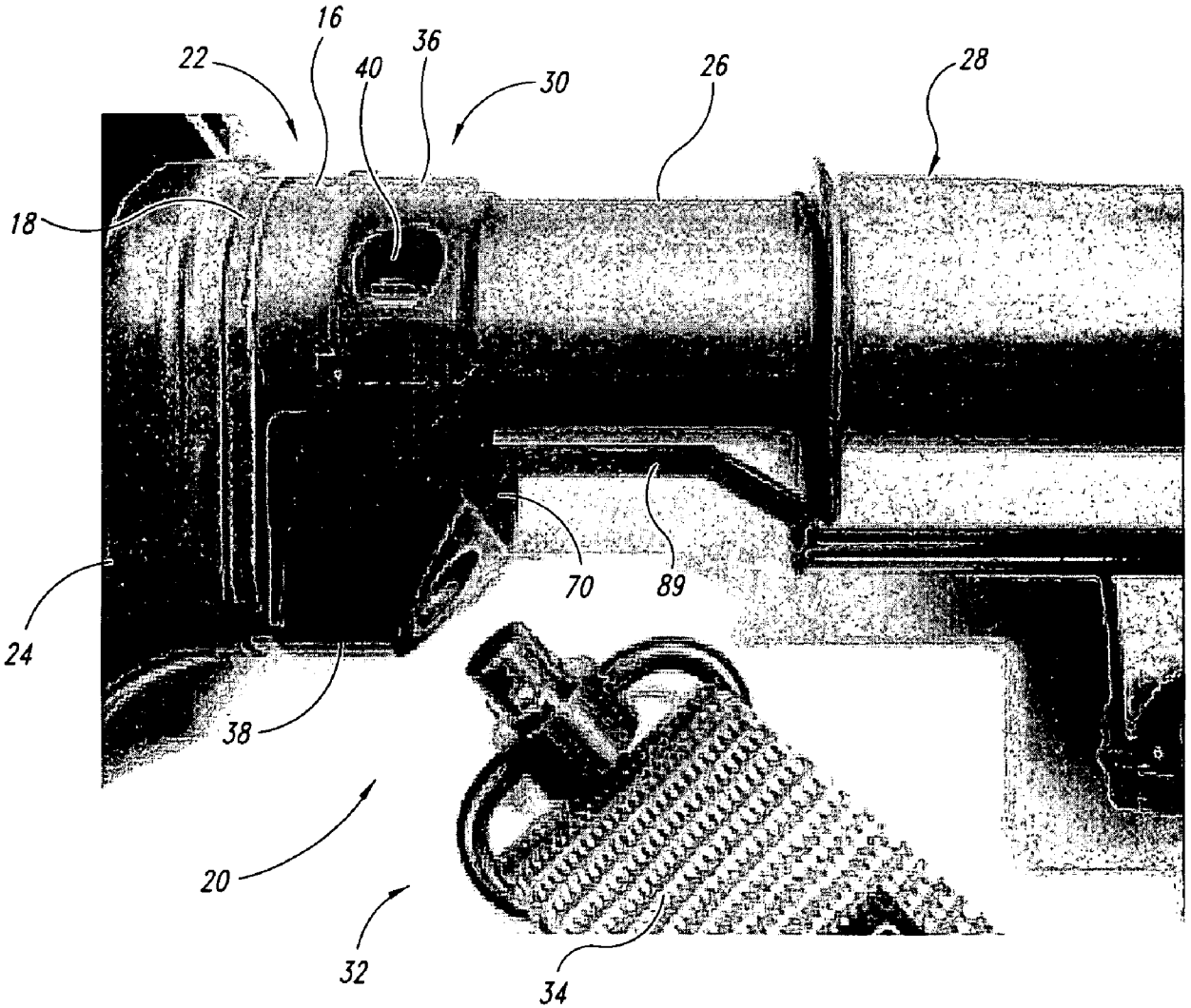
FIG. 1 is an isometric illustration of a sling mount system for a weapon in accordance with the present invention.
Figure 2:
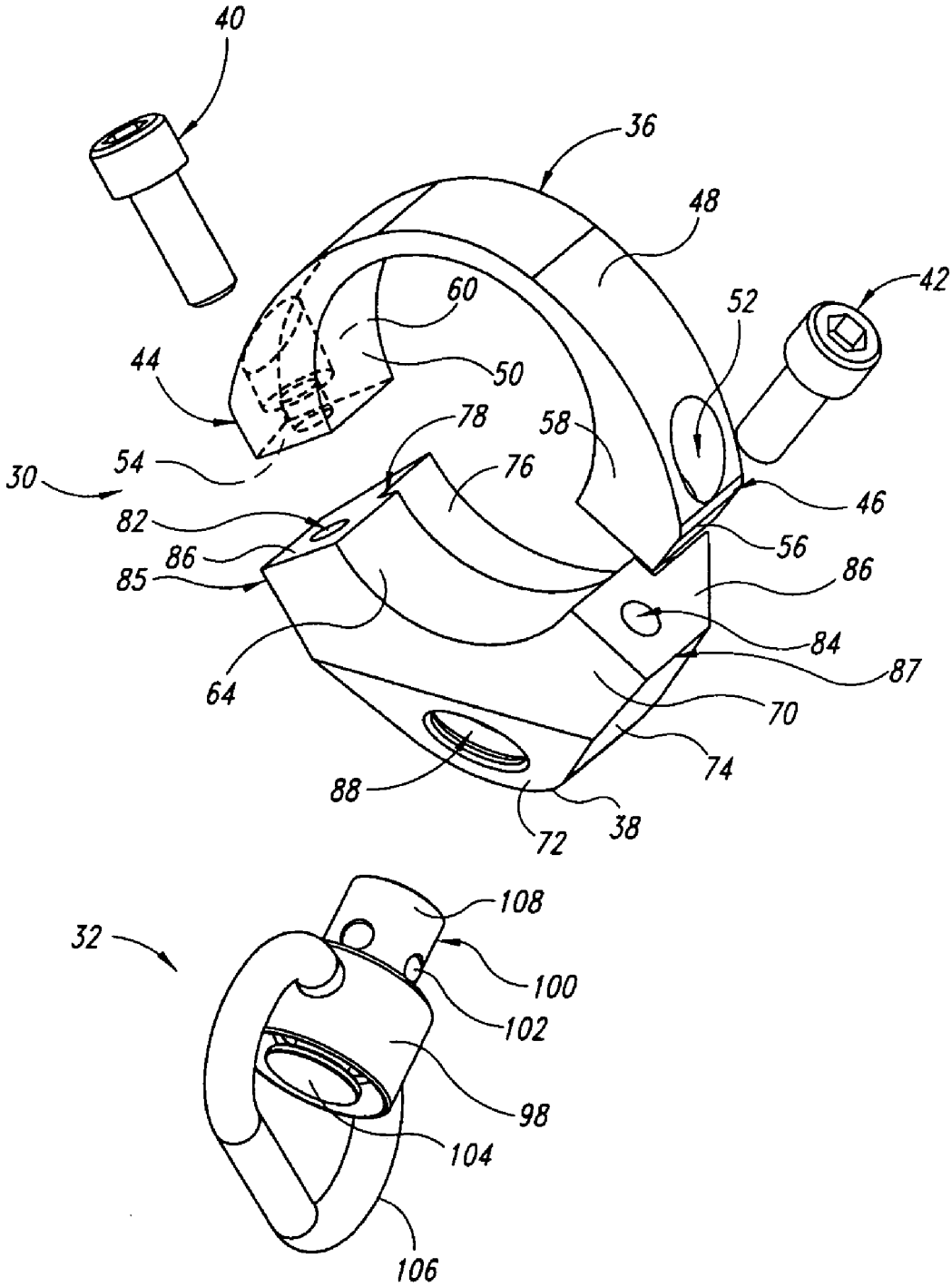
FIG. 2 is an exploded isometric view of the sling mount system of FIG. 1.

Referring initially to FIG. 1, shown therein is a sling mount system 20 for a weapon, in this case a rifle 22. It is to be understood that while the sling mount system 20 is described in the context of attaching a sling to a rifle, one or more features of the present invention can be applied to other weapons known to those in the art. Moreover, the present invention can be adapted for use with other objects having a similar configuration. Thus, the present invention is not to be limited to the representative embodiment illustrated and described herein.

In this embodiment, the rifle 22 includes a weapon receiver 24 removably coupled to a buffer tube 26 that in turn is associated with a butt stock, denoted generally with reference number 28. Because the foregoing configuration of weapon is well known, it will not be described in greater detail. Briefly, the buffer tube 26 uncouples from the weapon receiver 24 to expose an end of the cylindrical buffer tube 26. A receiver extension nut 16 is used to couple the buffer tube 26 to the weapon receiver 24. Interposed between the nut 16 and the weapon receiver 24 is a receiver end plate 18 that is keyed to engage a keyhole (not shown) in the buffer tube 26 to prevent relative rotation of the buffer tube 26 and weapon receiver 24 when the nut 16 is tightened.

The sling mount system 20 in this embodiment includes a sling mount 30 attached to the buffer tube 26 and a swivel mount 32 for coupling a sling 34 to the mount 30 and, thus, to the rifle 22. As shown more clearly in FIGS. 2-6, the mount 30 is configured as a two-part clamp that has a top clamp member 36 and a bottom clamp member 38 attached together by two fasteners 40, 42. The top clamp member 36 has a generally arcuate shape spanning from a first end 44 to a second end 46. An exterior surface 48, having a first radius, opposes an interior surface 50, having a second radius that is smaller than the first radius, which thus forms an enlarged structural volume at each of the first and second ends 44, 46.

Figure 7:
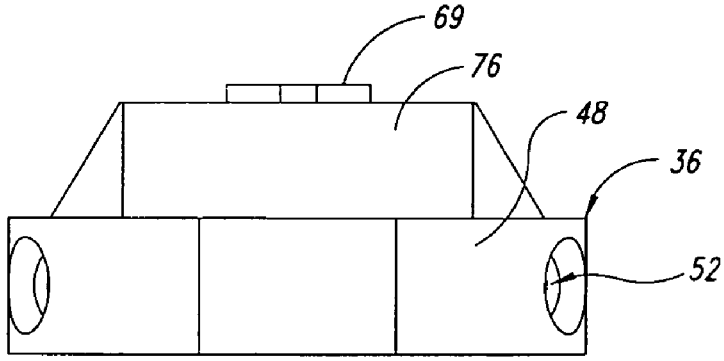
FIG. 7 is a top view of the sling mount of FIG. 1.
Figure 8:
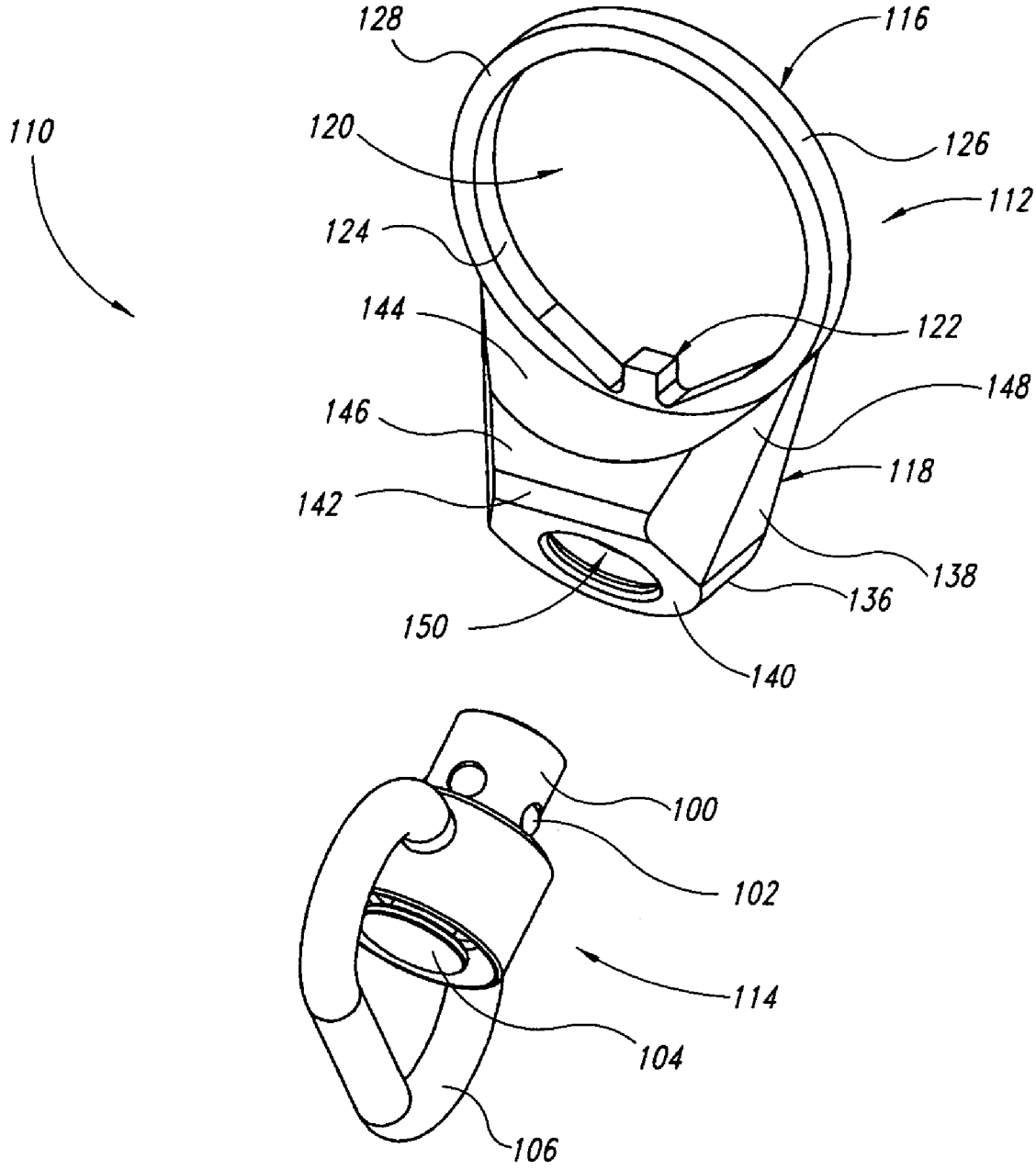
FIG. 8 is an isometric view of an alternative embodiment of a sling mount system formed in accordance with the present invention.
Figure 9:
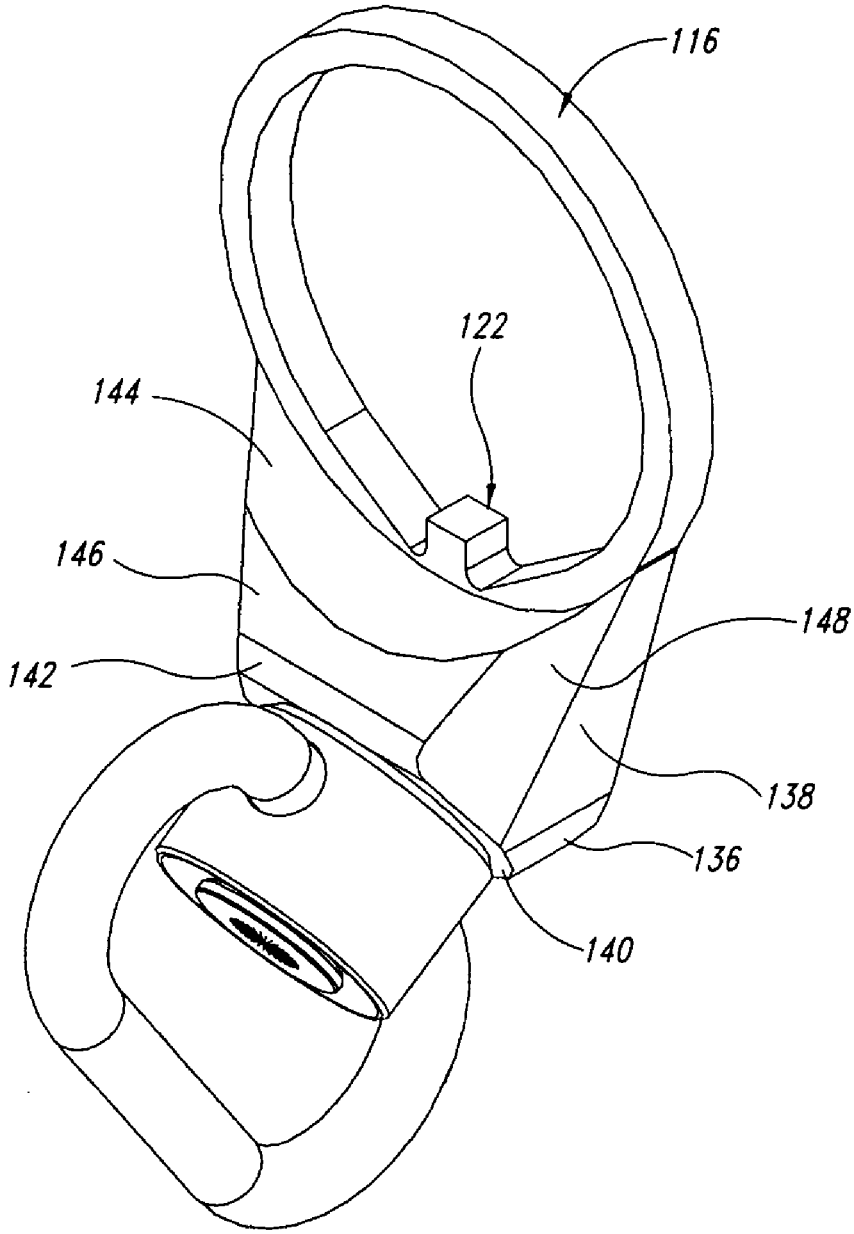
FIG. 9 is an isometric illustration of the sling mount of FIG. 8 with the swivel connector coupled to the sling mount.
Figure 10:
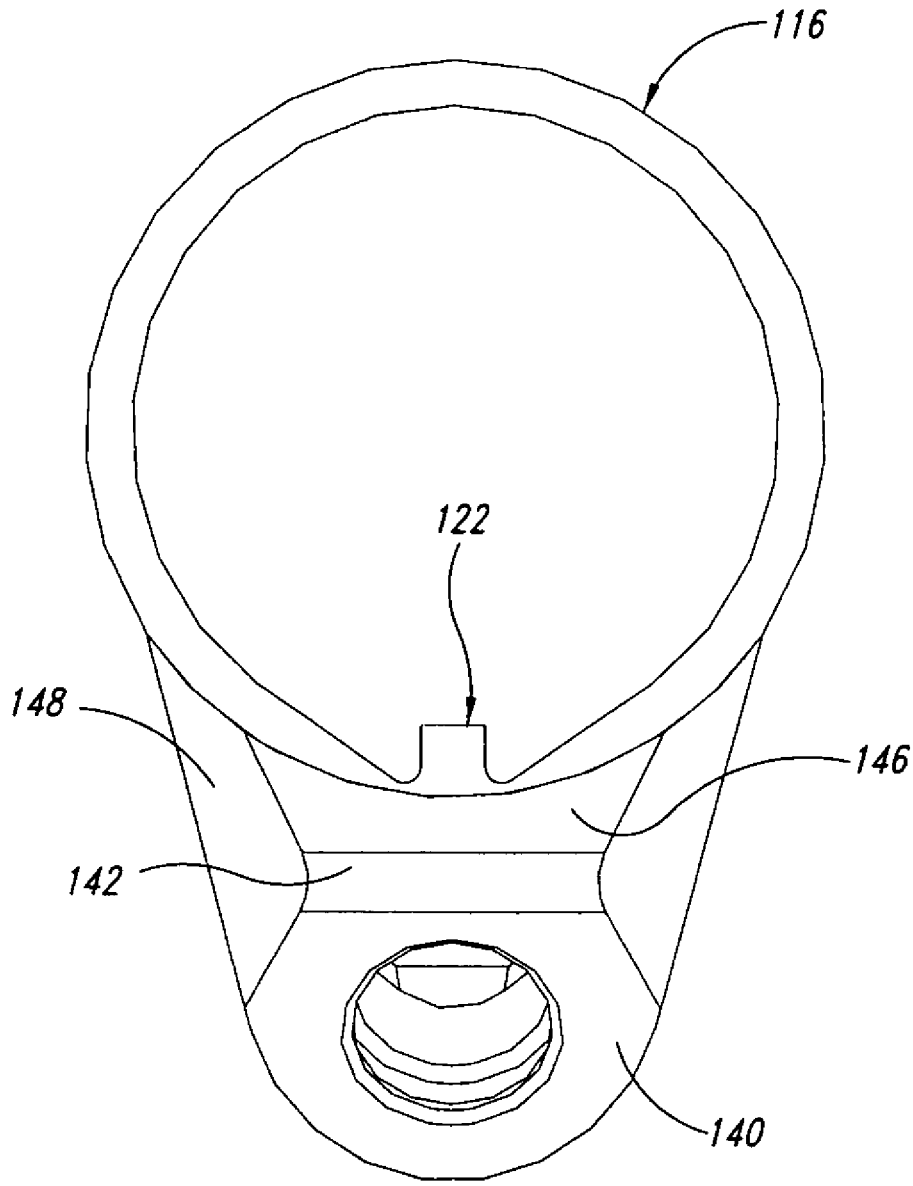
FIG. 10 is a front view of the sling mount of FIG. 8.
Figure 11:
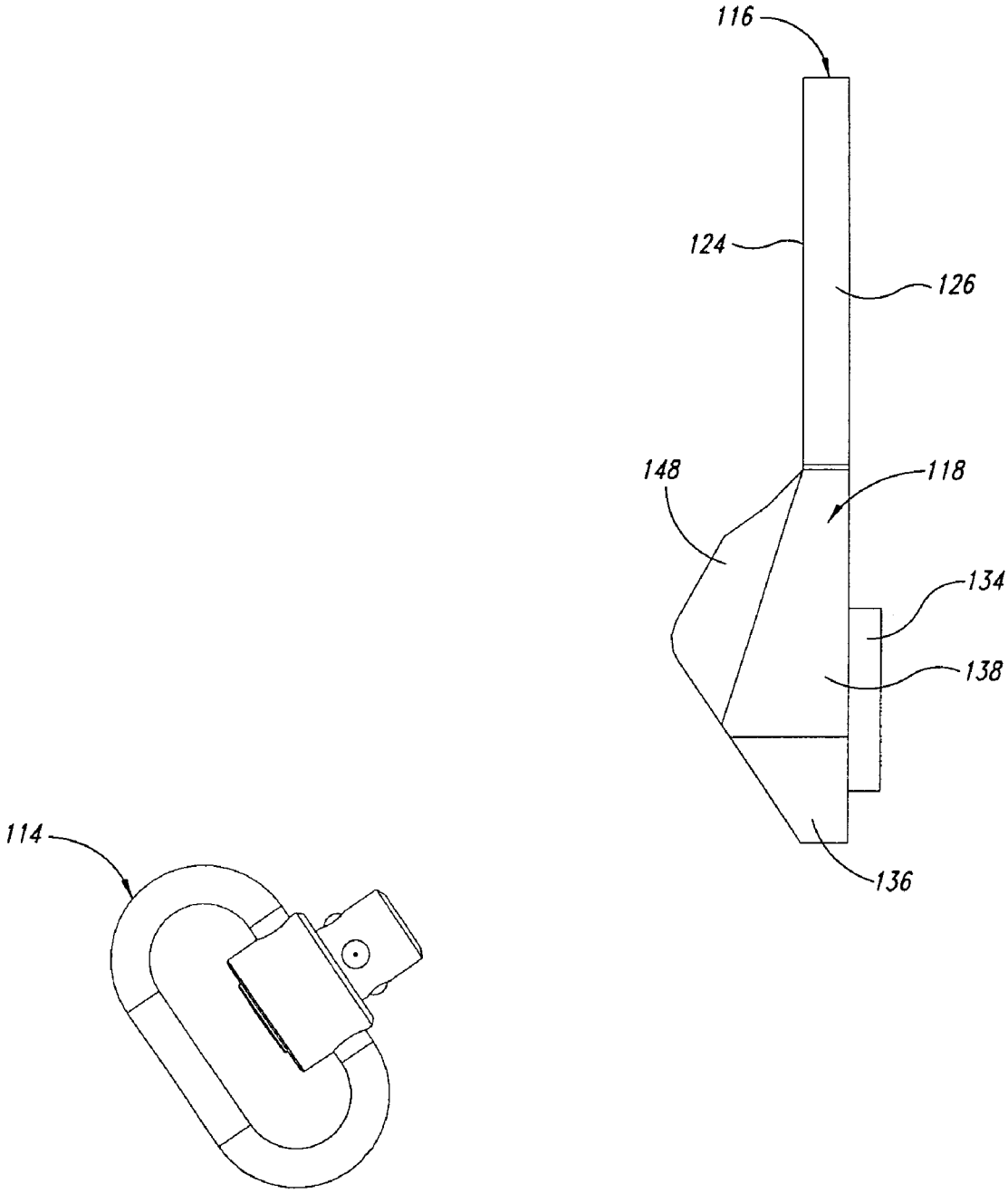
FIG. 11 is a side view of the sling mount of FIG. 8.
Figure 12:
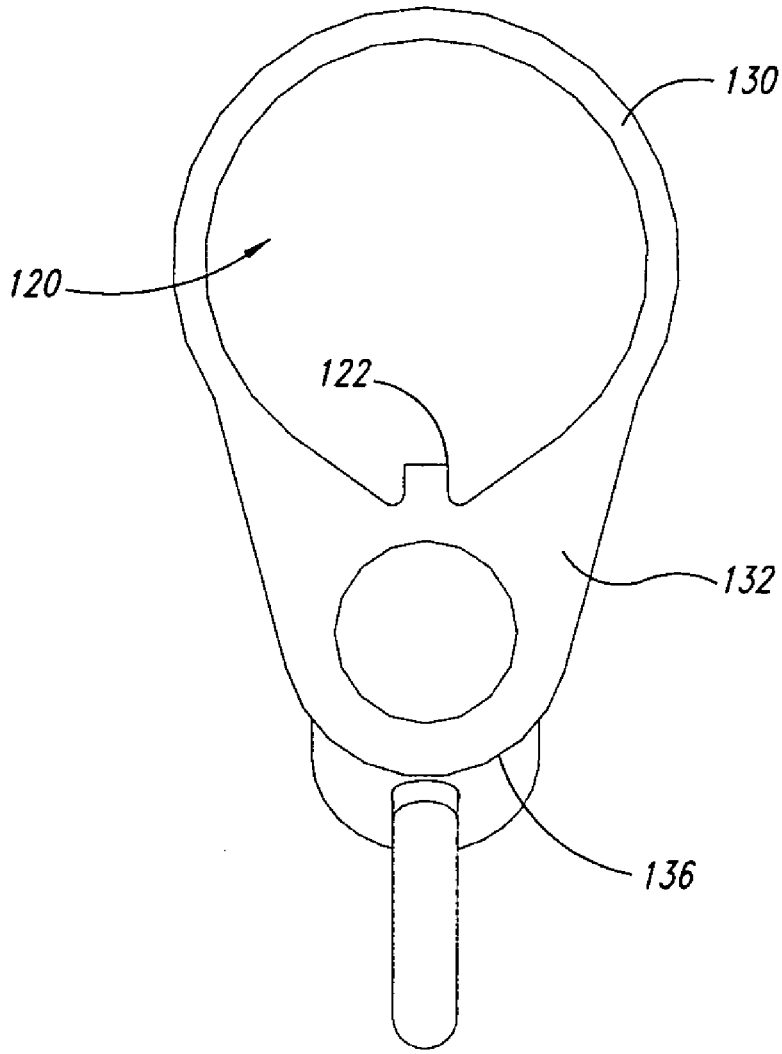
FIG. 12 is a back view of the sling mount of FIG. 8.
Figure 13:
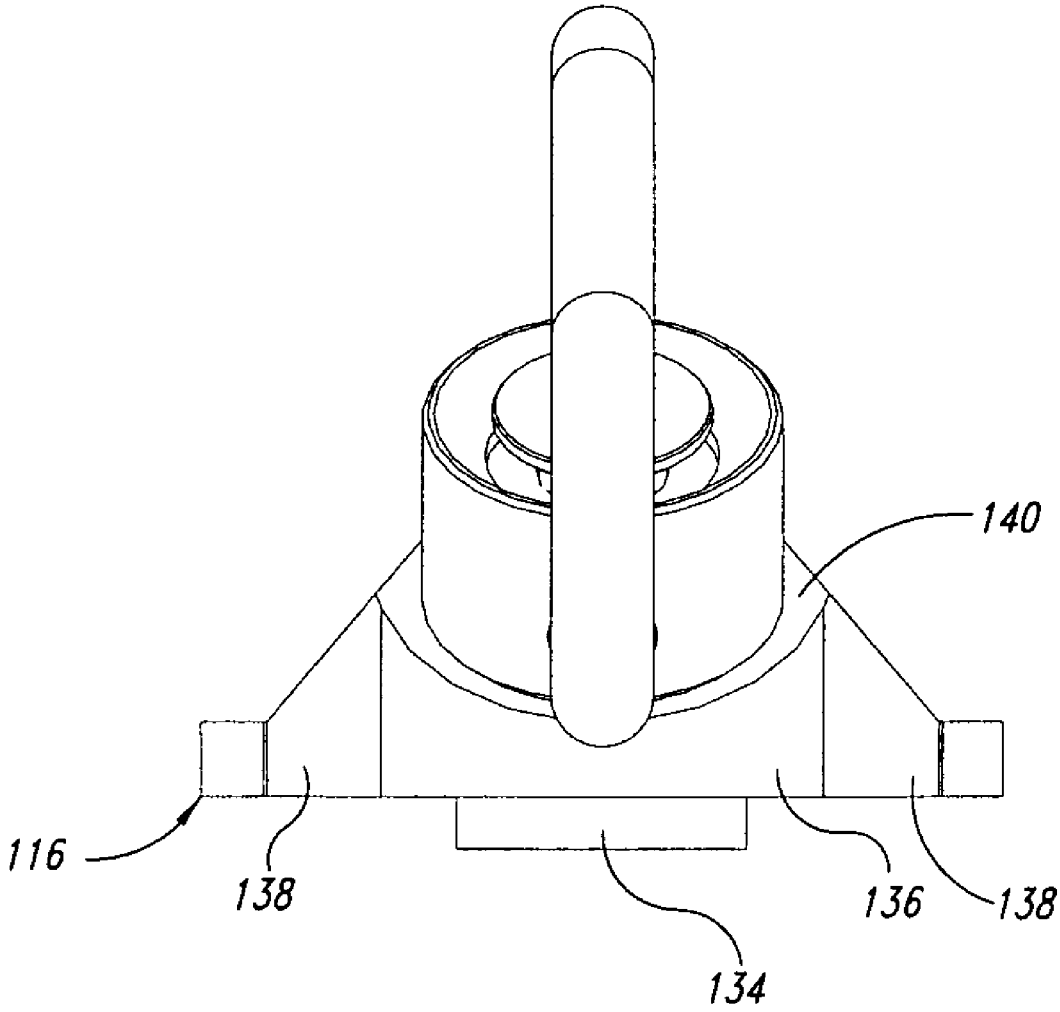
FIG. 13 is a bottom view of the sling mount of FIG. 8.
Figure 14:
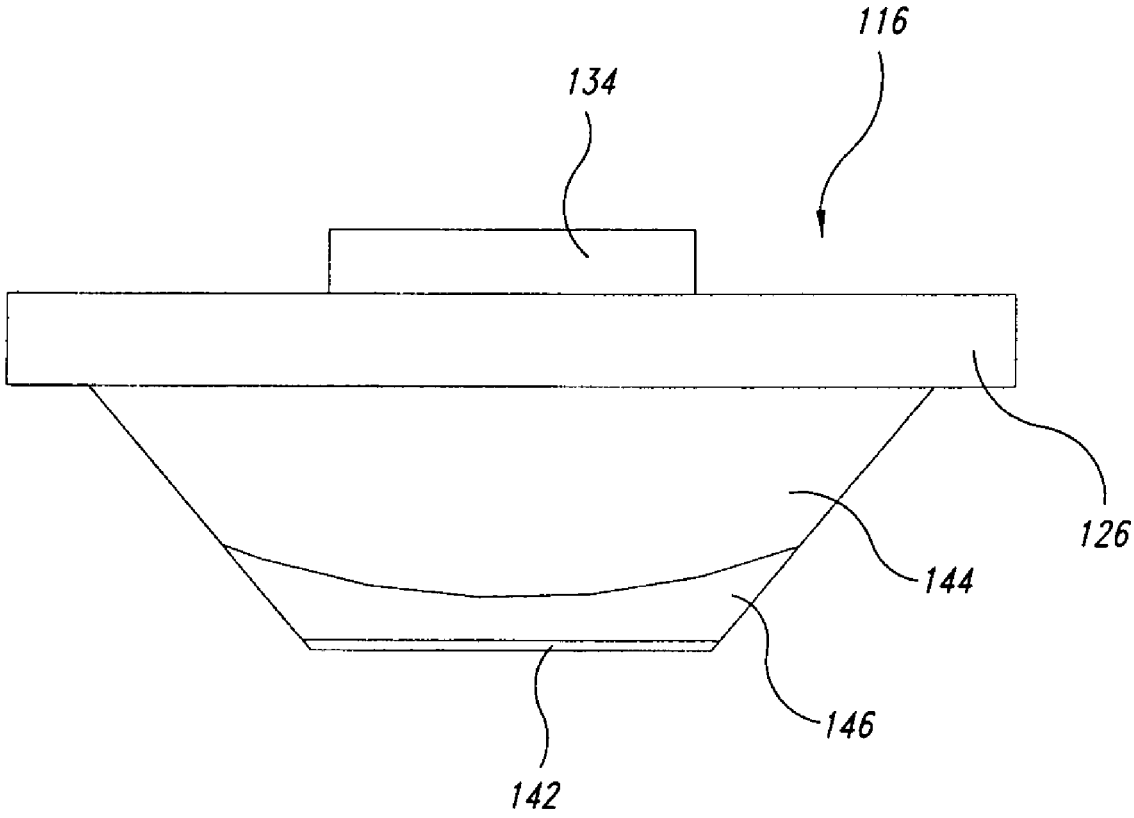
FIG. 14 is a top view of the sling mount of FIG. 8.

An opening 52 is formed in each end 44, 46 extending from the exterior surface 48 to a bearing surface 54 that is approximately orthogonal to its intersection with the interior surface 50. The opening 52 is sized to accommodate the fasteners 40, 42, and it is preferably countersunk through the exterior surface 48 to form a shoulder 62 (shown in FIG. 7) against which the fasteners 40, 42 bear. An end surface 56 is formed substantially orthogonal to the exterior surface 48 and intersects with the bearing surface 54 at each of the first and second ends 44, 46. The top clamp member 36 has front and rear planar parallel faces 58, 60 that are substantially at a right angle to the previously-described surfaces 48, 50, 54, 56.

Figure 4:
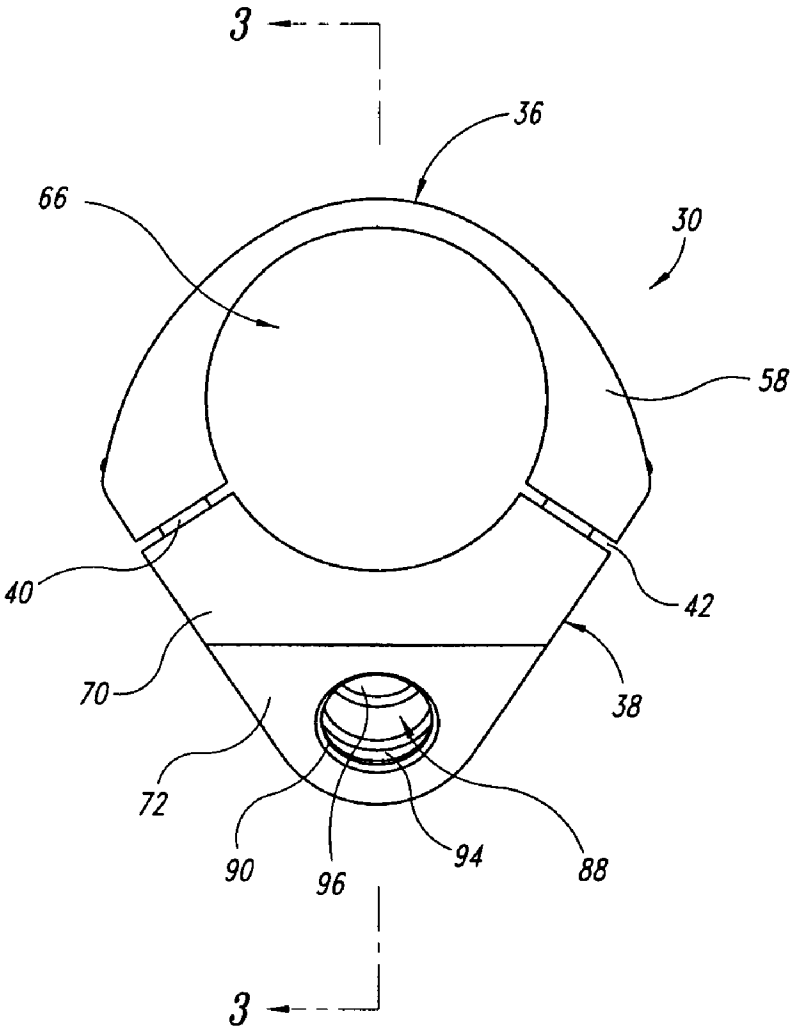
FIG. 4 is a front view of the sling mount of FIG. 1.
Figure 3:
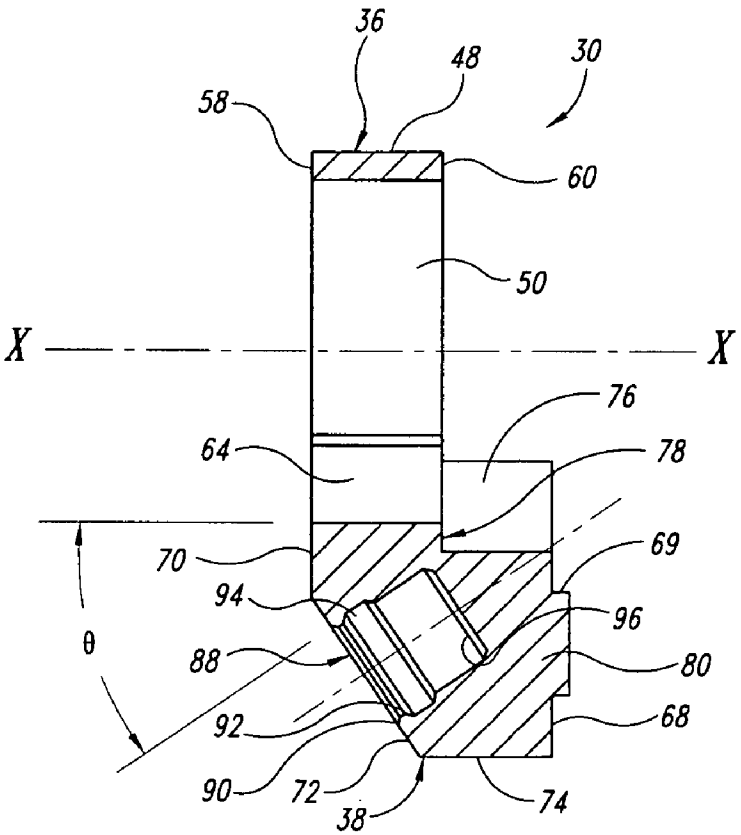
FIG. 3 is a side cross-sectional view of the sling mount of FIG. 1.
Figure 5:
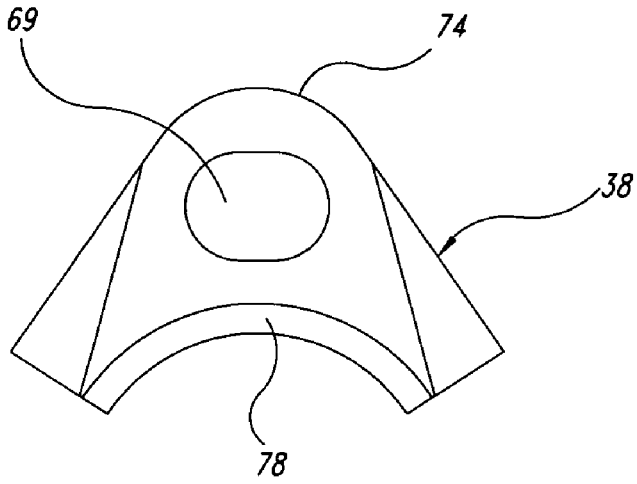
FIG. 5 is a back view of the lower clamp member of the sling mount of FIG. 1.
Figure 6:
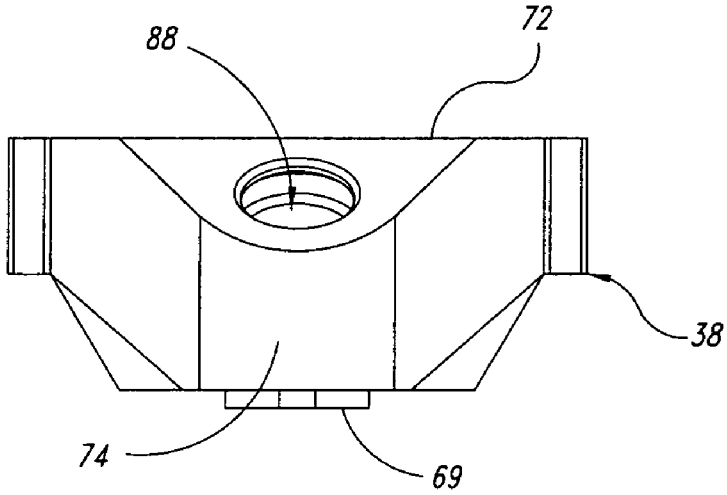
FIG. 6 is a bottom view of the sling mount of FIG. 1.

The bottom clamp member 38 has an arcuate interior surface 64 with a radius that matches the second radius of the interior surface 50 of the first clamp member 36. When the second clamp member 38 is attached to the first clamp member 36, their respective interior surfaces 50, 64 form a complete circular opening 66 having a longitudinal axis x as shown in FIG. 4. The size of the opening 66 is application dependent as is the shape of the opening 66, which is formed to tightly bear against the outside surface of the buffer tube 26, preferably without gaps, and without damaging the exterior surface of the buffer tube 26 or object to which it is attached.

The lower clamp 38 has a back face 68 with a projection 69 and a mutually opposing parallel upper front face 70. The projection 69 is sized and shaped to index with a recess (not shown) in the rear of the weapon receiver 24 to prevent the sling mount 30 from rotating about the longitudinal axis X. A lower front face angles away from the upper front face 70 and meets an exterior surface 74. Adjacent the lower front face 72, the exterior surface 74 is formed to be generally arcuate, and adjacent the upper front face the exterior surface 74 is generally planar. A stepped-down arcuate concave surface 76 is formed adjacent the interior surface 64 on a back side of the lower clamp 38 that defines a shoulder 78, which is formed as part of a rearward extension 80 of the lower clamp member 38.

The rearward extension 80 and the configuration of the arcuate interior surface 64 provide sufficient mass of material to support two threaded openings 82, 84 that are engaged by the fasteners 40, 42. The threaded openings 82, 84 open to a mating surface 86 on opposing ends 85, 87 of the lower clamp member 38. These mating surfaces 86 are formed to mate with the bearing surface 54 of the upper clamp member 36. The lower clamp member 38 is also sized so that the upper front face 70 bears against or is adjacent to a ridge 89 formed on a lower side of the buffer tube 26. This prevents the sling mount 30 from sliding towards the butt stock 28.

The lower member 38 has a receptacle 88 formed therein that receives the swivel connector 32. Ideally, the receptacle 88 is a cylindrically-shaped cavity or receiver hole that opens to the lower front face 72. As shown more clearly in FIGS. 3 and 4, the receptacle opening 90 is flared at the lower front face 72, and it is followed by a short section 92 at the nominal bore diameter, which in turn is followed by a groove 94 formed in the interior surface of the receptacle 88. The diameter after the groove 94 returns to the nominal size and concludes at a back wall 96.

The receptacle 88 has a longitudinal axis y that lies in the same plane as the longitudinal axis of the circular opening 66 and is at an angle θ of about 34.3° away from the x axis. The range of θ can be 10° to 75°, although the preferred range is 30° to 45°.

The swivel mount 32 is a standard commercially-available component that will not be described in detail herein. Essentially, the swivel mount 32 includes a body 98 having a nose 100 projecting therefrom. Spring loaded balls 102 extend from the circular sidewall 108 of the nose 100. The nose 100 is sized and shaped to be received within the receptacle 88, and the balls 102 are sized and positioned to snap into place in the groove 94 to retain the swivel connector 32 in engagement with the lower clamp member 38. A release button 104 in the body 98 is pressed to allow the balls 102 to retract and the swivel connector 32 to be removed from the lower clamp member 38. A ring 106 is pivotally coupled to the swivel body 98 to which is attached a sling, such as the sling 34 shown in FIG. 1.

The arcuate shape of the top clamp member 36 is preferably of an arc greater than 180° in the interior surface 50. This provides additional material at the first and second ends 44, 46 on the upper clamp member 36 and on the ends 85, 87 in the lower clamp member 38 for the fasteners 40, 42. Because of the extent of the arc of the interior surface 50 of the upper clamp member 36, it is necessary to remove the collapsible butt stock 28 to enable the upper clamp member 36 to be slid thereon. The lower clamp member 38 can then be attached, or it can be attached prior to sliding onto the buffer tube 26. After the upper clamp and lower clamps are properly aligned, the mount 30 is tightened in the desired position on the buffer tube 26. Preferably, the receptacle 88 has its longitudinal axis in the same plane as the longitudinal axis of the buffer tube but angled away from the buffer tube as it is angled away from the opening 66 formed by the mount 30 as described above.

The swivel connector 32, after being engaged with the sling 34, can then be quickly and easily coupled to the mount 30 by pushing the nose 100 into the receptacle 88 until the biased retaining balls 102 are engaged with the groove 94.

An alternative embodiment of the invention is illustrated in FIGS. 8-14 wherein a sling mounting system 110 is shown to include a unitary mount 112 and a swivel connector 114. Here, the unitary mount 112 has a mounting ring 116 integrally formed with a receiver body 118.

The ring 116 has an interior surface 124 on which is formed a key 122 that projects into the opening 120. An exterior surface 126 of the ring 116 is shown as being substantially round, but it is to be understood that it can have any shape that is dictated solely by ornamentation, as may the front and back exterior faces 128, 130 and the faces, sides, and edges of the receiver body 118, to be described in more detail hereinbelow. The key 122 is sized and shaped to fit into a keyway (not shown) in the buffer tube 26, thus aligning the mount 112 with a longitudinal axis of the weapon.

The receiver body 118 has a configuration similar to the lower clamp member 38 described above. In this embodiment, the receiver body 118 is integrally formed with the ring 116 to extend away from the key 122 or in a direction opposite to the direction that the key 122 projects. The receiver body 118 includes a back surface 132 that is substantially coplanar with the back face 130 of the ring 116. A projection 134 extends from the back surface 132 of the receiver body 118 and is formed for the purpose of indexing with a recess in the rear of the weapon receiver 24 to prevent the sling mount from moving or becoming rotated from its desired position.

The receiver body 118 includes an arcuate bottom surface 136 that intersects with substantially planar sides 138, which extend upward and taper down to a width of the ring 116. A front face 140 angles upward from the bottom surface 136 and away from the back surface 132 where it intersects a nose 142 that curves back towards the ring 116. A concave arcuate dish surface 144 is formed adjacent the ring 116 and transitions to the nose 142 via a substantially planar transition face 146. A tapered face 148 is formed on each side of the nose 142 that intersects with the angled front surface 140, the nose 142, the transition face 146, the dished surface 144, the sides 138, and the ring 116.

A receptacle in the form of a cylindrical cavity 150 is formed in the receiver body 118 that opens to the angled front face 140. This cavity 150 has an internal configuration identical to the receptacle 88 described above in connection with FIGS. 1-7 and hence will not be described in greater detail herein.

The swivel connector 114 is of a construction similar to the swivel connector 32 that is likewise described above in connection with FIGS. 1-7 and will also not be described in greater detail herein. Briefly, and using the same reference numbers for identical parts with respect to the swivel connector 32, the swivel connector 114 includes the nose 100 sized and shaped to be slideably received within the receptacle cavity 150, and it is retained within the receiver body 118 using the same spring loaded detent balls 102 as in the previous embodiment.

Ideally the mounts 30, 112 are formed from 6061-T6 aluminum that has a hard black anodized finish. It is to be understood, however, that other materials and finishes may be used as necessitated by a particular application. Hence, while representative embodiments of the present invention have been illustrated and described hereinabove, it is to be understood that various changes may be made therein without departing from the spirit and scope of the invention. Thus, the invention is to be limited only by the scope of the claims that follow.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

Figure 15:
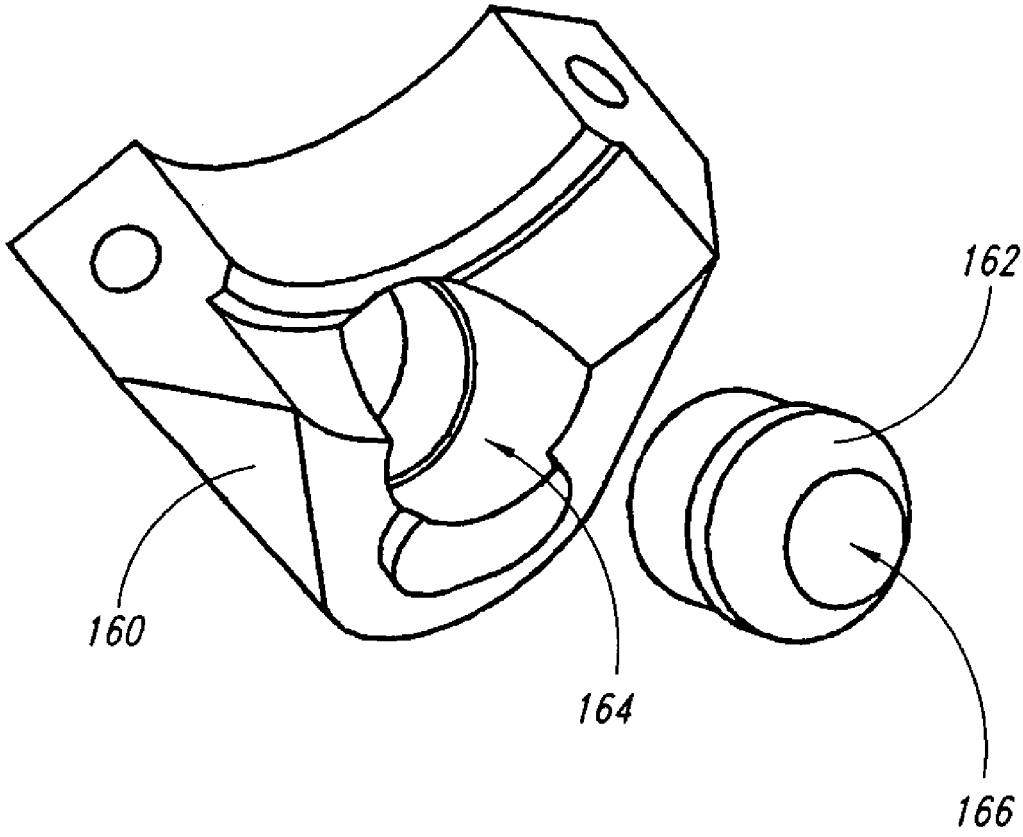
FIG. 15 is an isometric projection of a bottom clamp member formed in accordance with an alternative embodiment of the present invention.

From the foregoing it will be appreciated that, although specific embodiments of the invention have been described herein for purposes of illustration, various modifications may be made without deviating from the spirit and scope of the invention. For example, in FIG. 15 is shown a bottom clamp member 160 in which an insert 162 is received within the receptacle cavity 164. Ideally the insert is formed of stainless steel, although other material of similar strength and wear characteristics may be used. The insert has an opening or longitudinal axial bore that is co-axial with the receptacle and is sized and shaped to receive a corresponding nose portion of a swivel connector (not shown) such as the nose 100 illustrated and described above. Preferably the insert 162 is press fit in to the cavity 164 with a tight fit, although it can be retained in place with adhesive, welding, or other known methods. Accordingly, the invention is not limited except as by the appended claims.

The invention claimed is:

1. A sling mount, comprising:

a first clamp member having an arcuate-shaped opening in the range of 180° to 270°;

a second clamp member having an arcuate-shaped opening configured to define a ring that circumscribes an opening when attached to the first clamp member; and a receptacle formed in the second clamp member having a longitudinal axis that is aligned with a central longitudinal axis of the opening formed by the first and second clamp members, and wherein the longitudinal axis of the receptacle angles away from the longitudinal axis of the opening in the range of 10° to 60°, the receptacle comprising an open first end, a closed second end, and an internal circumscribing groove.

2. The mount of claim 1, further comprising a swivel connector configured to be slidably received in the receptacle and to cooperate with the internal groove to hold the swivel connector in the receptacle.

3. The mount of claim 2 wherein the receptacle comprises an insert formed of stainless steel received in the receptacle and having a longitudinal axial bore sized and shaped to receive a nose portion of the swivel connector.

4. A weapon, the weapon comprising:

a butt stock having a buffer tube attached to a receiver; and a sling mount attached to the buffer tube, the sling mount comprising a first clamp member and a second clamp member coupled together and defining a ring that circumscribes and clamps to the buffer tube, and a receptacle formed in the second clamp member, the second clamp member having a body and a face formed on the body, the face oriented in the direction of the butt stock, the second clamp member farther comprising a bore formed therein having an open first end, a closed second end, and an internal circumscribing groove, the receptacle having a longitudinal axis that angles away from a longitudinal axis of the buffer tube in the range of 10°to 60°.

5. The weapon of claim 4, further comprising a swivel connector configured to be slidably received in the receptacle and to cooperate with the internal groove to hold the swivel connector in the receptacle.

6. The weapon of claim 5 comprising an insert formed of stainless steel received in the receptacle and having a longitudinal axial bore sized and shaped to receive a nose portion of the swivel connector.

* * * * *